US006186150B1

(12) United States Patent
Lo

(10) Patent No.: US 6,186,150 B1
(45) Date of Patent: Feb. 13, 2001

(54) HAIR ROLLER CLOTH AND HAIR ROLLERS FOR HAIRDRESSING

(76) Inventor: Zhen-Xing Lo, No. 4, Zhu-Wei Rd, Wei-Nei Village, Kan-Ding Town, Ping-Dong Hsien (TW)

( * ) Notice: Under 35 U.S.C. 154(b), the term of this patent shall be extended for 0 days.

(21) Appl. No.: 09/418,257

(22) Filed: Oct. 15, 1999

(51) Int. Cl.[7] ..... A45D 1/00
(52) U.S. Cl. ..... 132/269; 132/229; 132/248
(58) Field of Search ..... 132/207, 232, 132/268, 255, 256, 233, 241, 271, 252, 251, 250, 230, 229, 245, 248, 247, 222, 269; 219/222, 223, 224, 225

(56) References Cited

U.S. PATENT DOCUMENTS 1,593,055 * 7/1926 Arnole ..... 132/229
2,140,243 * 12/1938 Moody et al. ..... 132/222
2,465,745 * 3/1949 Orr et al. ..... 132/255
2,853,080 * 9/1958 Brancaccio ..... 132/228
2,896,638 * 7/1959 Korsmo ..... 132/252
3,530,863 * 9/1970 Foster ..... 132/245
3,960,156 * 6/1976 Thompson ..... 132/245
5,558,107 * 9/1996 Kim ..... 132/228
5,979,465 * 11/1999 Marrese et al. ..... 132/248

* cited by examiner

*Primary Examiner*—Pedro Philogene
(74) *Attorney, Agent, or Firm*—Dougherty & Troxell

(57) ABSTRACT

A hair roller cloth and a hair roller includes a hair roller made of heat-resistant material and having mainly a circular cross-section of the same diameter all along its length or of different diameter regularly changing all along its length so as to set various curlings and waves, and a hair roller cloth directly wound around the hair roller and having ceramics powder coated on an outer surface to be heated up by a heating member provided flatly in the cloth and to produce special function for hot setting hairs.

9 Claims, 9 Drawing Sheets

HAIR ROLLER CLOTH AND HAIR ROLLERS FOR HAIRDRESSING

BACKGROUND OF THE INVENTION

This invention relates to hair roller cloth and hair rollers for hairdressing, particularly to one possible to handle swiftly, to set hairs into various curlings and waves, to protect hairs from harm, and to be replaced easily in case of breaking.

As to cold setting of hairs according to a conventional method, a hairdresser firstly winds hairs on a hair roller and then surrounds hairs hair roller with a cloth added with a setting chemical, and then baking the hair on the hair roller with heat for a period of time. Then the setting chemical is washed off the hairs and they are coated with another kind of chemical and baked for another period of time, checking always during baking if the hairs are set in good curls or waves or not. Then the hair roller cloth and the hair roller are removed in case of finishing setting. Cold setting generally takes about two hours.

As to heat setting of hairs according to a conventional method, a hairdresser winds hairs on a hair roller, and surrounds them with a hair roller cloth added with setting chemical producing heat for setting hairs. Heat setting generally takes a shorter time than that needed in cold setting.

However, conventional hair roller cloth and hair rollers are not so ideal, not having good practicability and effects, especially in the field of heat supplying. And hairs may be harmed more or less after setting, not to mention of nourishing hairs. Besides, since cold or heat setting cannot be operated fast, it is possible to harm hairs resulting in not so good curling or wave.

SUMMARY OF THE INVENTION

This invention intends to offer hair roller cloth and hair rollers for hairdressing, characterized by the hair roller cloth having ceramics powder coated on an outer surface and a heating member to be electrified to produce heat to heat up the ceramics powder to produce its special function (producing far infrared light) for hairdressing. The hair roller is made of heat-resistant material and has a circular cross-section with a diameter changing all along the length to form a curved-up or curved-down outer surface for styling hairs.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
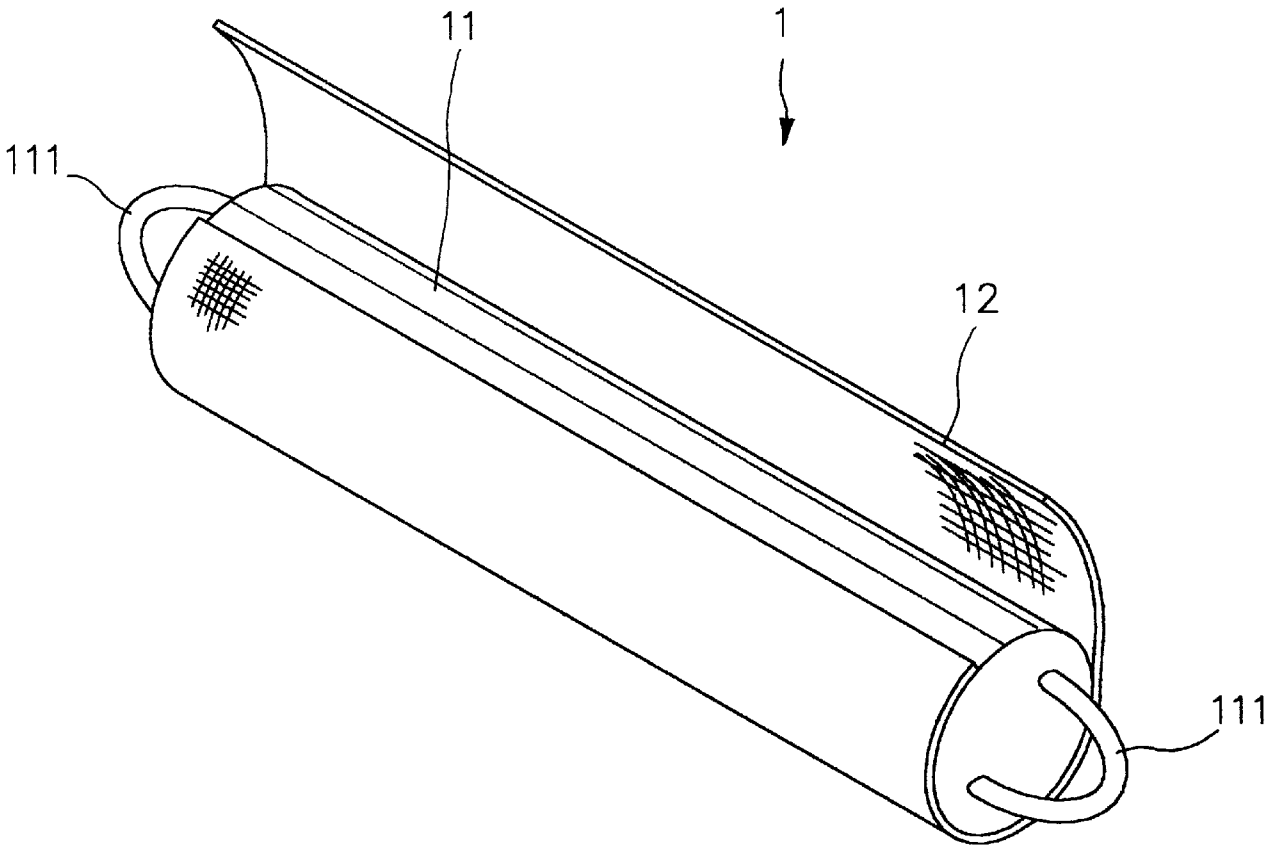
FIG. 1 is a perspective view of a hair roller cloth wound on a hair roller in the present invention.
Figure 2:
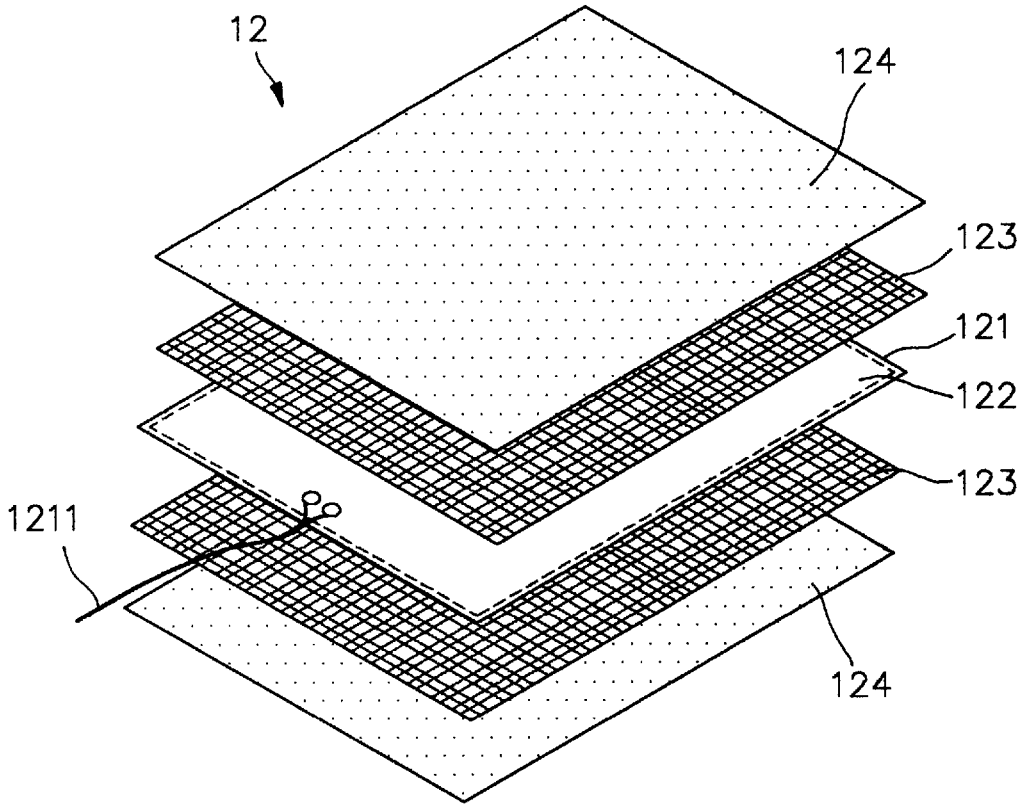
FIG. 2 is an exploded perspective view of the hair roller cloth in the present invention.
Figure 3:
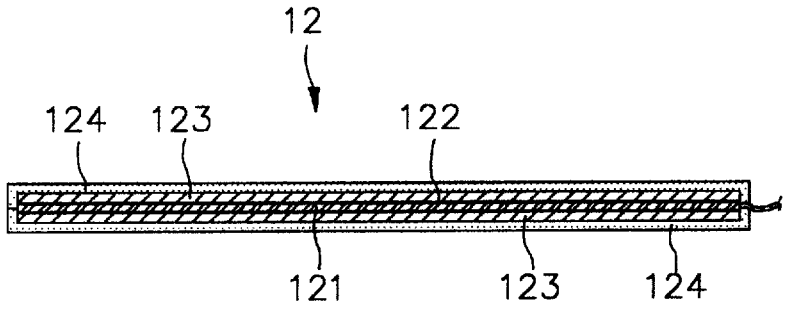
FIG. 3 is a cross-sectional view of the hair roller cloth in the present invention.

A preferred embodiment of a hair roller cloth and hair rollers for hairdressing in the present invention, as shown in FIGS. 1, 2 and 3, includes a hair roller cloth 12 and a hair roller 11.

The hair roller 11 is made of heat-resistant material such as heat-resistant plastic or aluminum, having a circular cross-section of the same diameter along the length or different diameters changing gradually along the length. So in the present invention, a single hair roller can set or style various curlings or waves for hairs, increasing its practicability and effect.

The hair roller cloth 12 its to be wound around a hair roller 11, having ceramics powder coated on its outer surface and a heating member to produce heat by electricity. The objective of using ceramics powder in the invention is far infrared light possible to be produced by it when it is heated up by the heating member provided in the hair roller cloth 12. And far infrared light can protect and nourish hairs during the setting process, never harming the quality of hairs and keeping curls and waves for a longer period of time than the conventional setting method.

The hair roller cloth 12 has a layer of heating member 121, an insulating layer 122, two metal net layers 123, and two cotton cloth layers 124 piled together.

The heating member 121 is made with nichrome or other material having PTC (positive temperature coefficient), and lead wires 1211 are connected to a side edge of the heating member 121 for connecting it with power to let the heating member heat up.

The insulating layer 122 is coated or covered on an outer surface of the heating member 121, insulating the heating member 121 from other layers, preventing electricity from leaking, ensuring safety of the hair roller cloth.

The two metal net layers 123 are placed on an upper and a lower surface of the insulating layer 122 for transmitting heat of the heating member 121 to the two cotton cloth layers 124, and in addition, having function of bending and positioning in the bending condition.

The two cotton cloth layers 124 are placed on an outer side of the two metal net layers 123, having ceramics powder coated on an outer surface of each cotton cloth layer 124, and surround the two metal net layers 123, the insulating layer 122 and the heating member 121 to integrate the hair roller cloth as a unit.

Then if the heating member 121 is heated up, with electricity turned on, the metal net layers 123 receiving the heat and transmitting it to the cotton cloth layers 124, which then are heated to let the ceramics powder also heat to produce far infrared light for setting hairs. The cotton cloth 124 is made of comparatively fine threads, never giving harm to hairs when it touches them. The part of the cotton cloth layer 124 wound on an inner side of the hair roller 11 does not need to have ceramics powder coated to save its cost, because that part is not the main portion of setting hairs.

Figure 4:
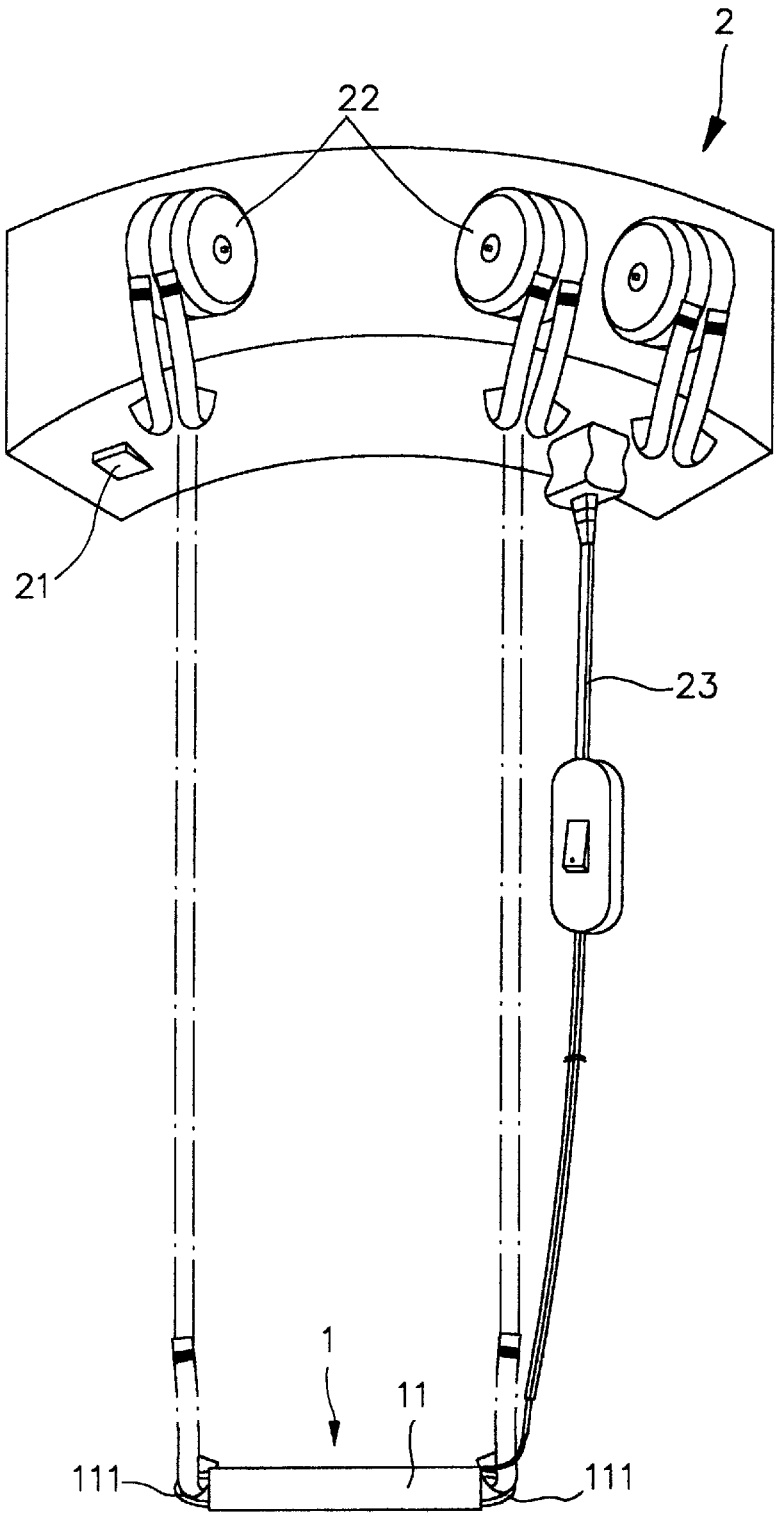
FIG. 4 is a perspective view of a hanging device for the hair roller in the present invention.

Further, as shown in FIG. 4, a hanging ring 111 is respectively provided at two sides of the hair roller 11, and a hanging unit 2 is provided to hang the two hanging rings 111 to balance and put the hair roller 11 at the most proper location. The hanging unit 2 has a main switch 21 to turn on and off power, and a plurality of height adjusters 22 for adjusting the height of the hair roller 11, and lead wires 23 connected to the hair roller 11, making up a large unit of hairdressing with the hair roller cloths 12 and the hair rollers 11.

Figure 5:
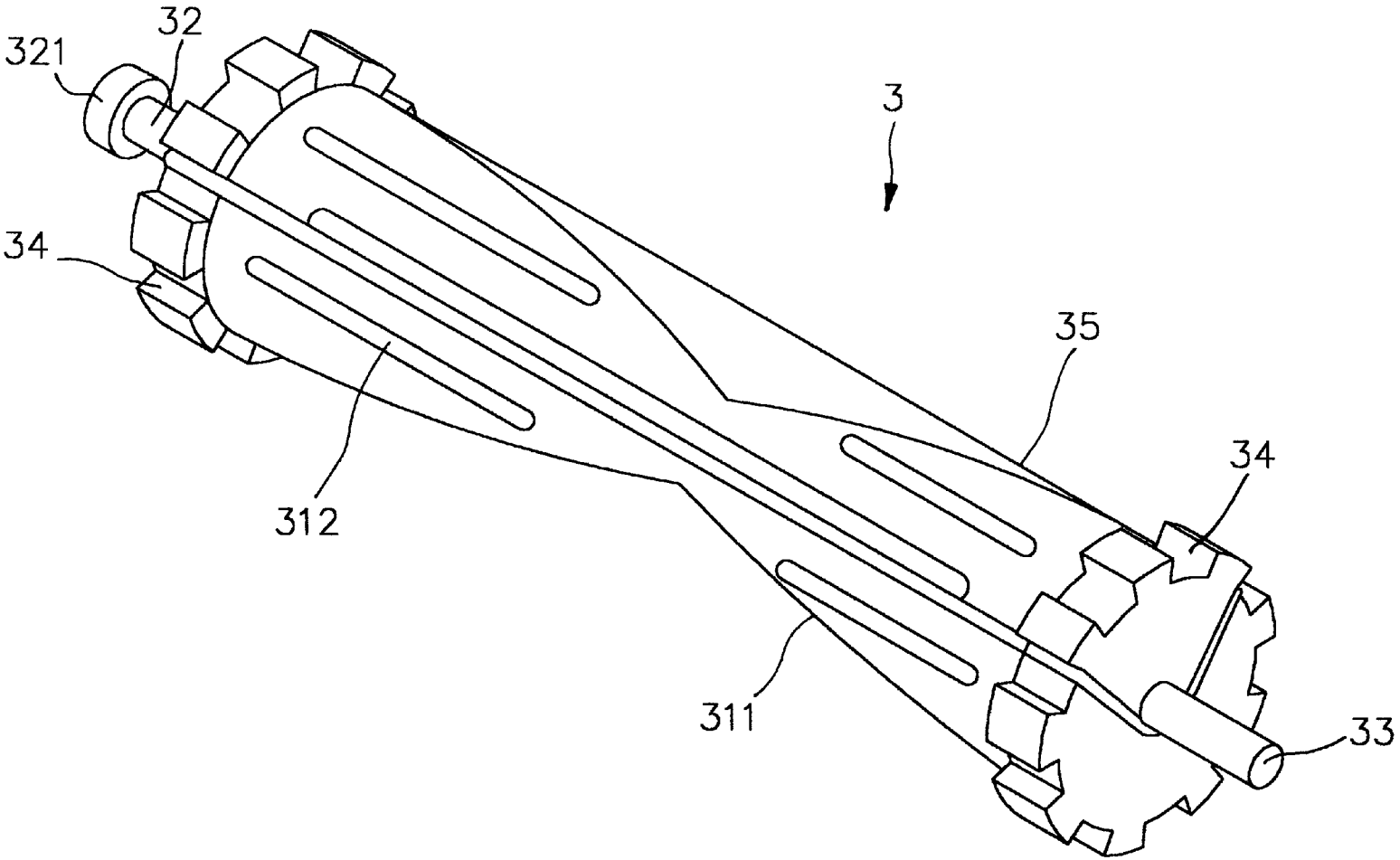
FIG. 5 is a perspective view of a first embodiment of a hair roller in the present invention.
Figure 6:
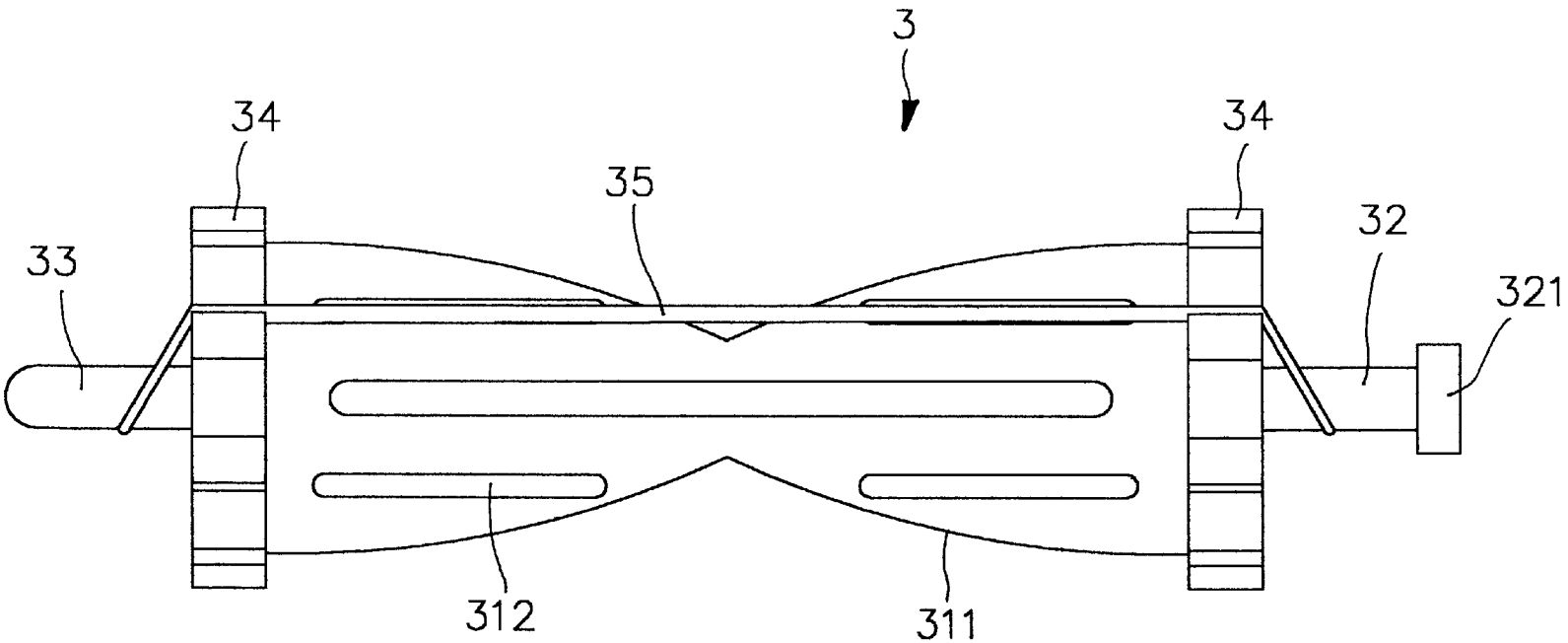
FIG. 6 is a side view of the first embodiment of a hair roller in the present invention.

Next the hair roller 3 shown in FIGS. 5 and 6 is a first embodiment, possible to be made of heat-resistant material manufactured in mass production, lowering its cost. The first embodiment of the hair roller 3 has a circular hollow cross-section of a diameter gradually changing regularly along the length to make a curved-up or a curved-down outer surface. Then hairs can be set into various curlings with the same hair roller 3. Further, the hair roller 3 has its two sides provided respectively with a fix rod 32, 33. And the fix rod 32 has a disc stop 321 formed at an outer end so that the hair roller 3 can be fixed on hairs by means of clamping means 35 such as a rubber ring, with the disc stop 321 keeping the rubber ring 35 from easily falling off. Then the hair roller 3 in the invention is quite easy to fix on hairs. Further, the hair roller 3 has a plurality of long narrow air holes formed in an outer surface for hot air to flow through out of the hair roller 3 to heat up hairs to get good curling. Further, the hair roller 3 has a toothed wheel formed inside the fix rod 32, 33 and having a separating groove 34 between every two teeth for a rubber ring to hook in to increase its length for more stably positioning the hair roller on hairs.

In using, first the hair roller cloth is wound around the hair roller 3, and then hairs coated with a chemical are wound on the hair roller cloth, positioning the hair roller 3 with rubber rings 35 hooking the fix rod 32 with a disc stop 321 and separating the rubber rings 35 with the separating grooves 34 and then the rubber rings 35 are hooked on the fix rod 33, finishing in fixing the hair roller 3 on the hairs. Then the member is electrified (or adding heating a chemical) for setting hairs.

Figure 7:
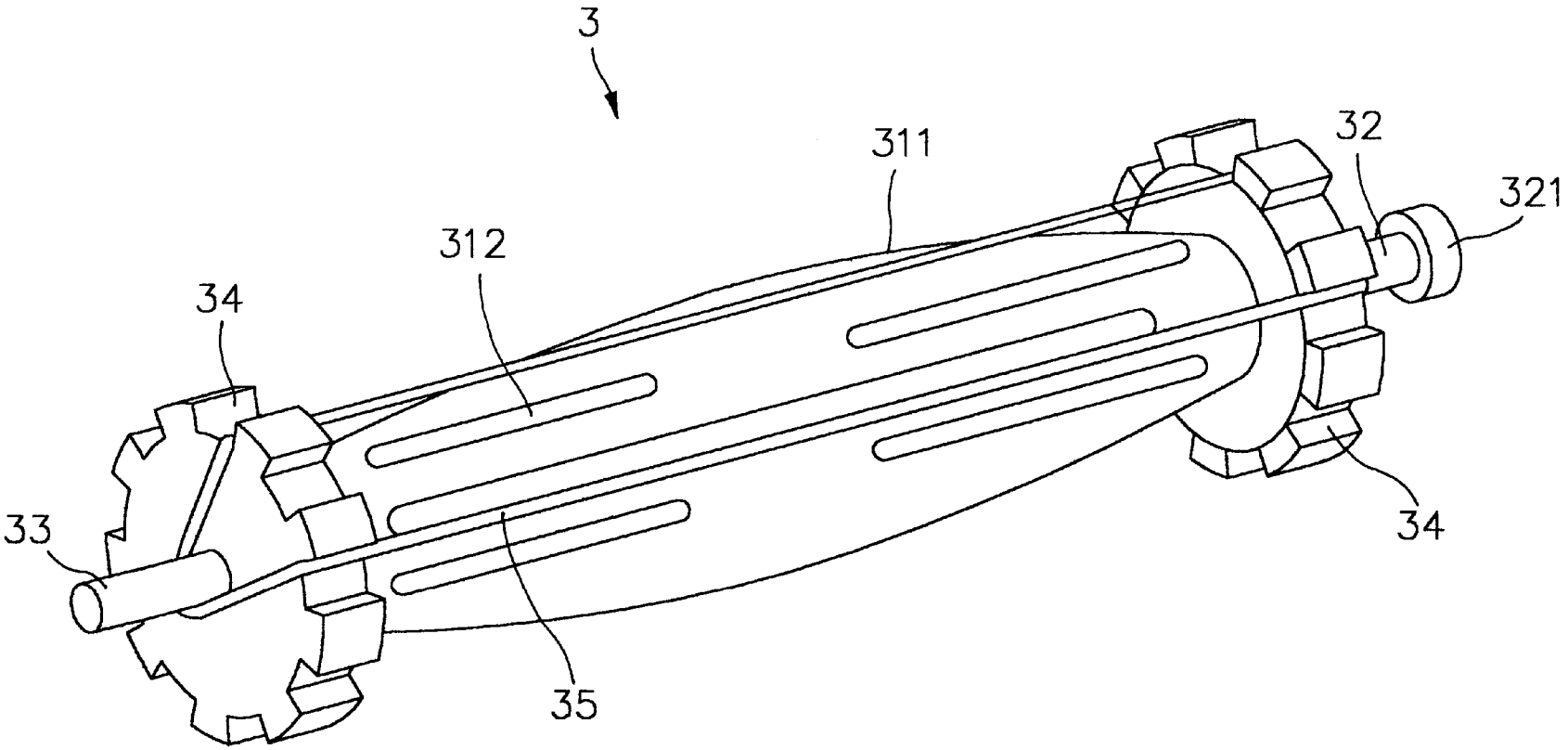
FIG. 7 is a perspective view of a second embodiment of a hair roller in the present invention.
Figure 8:
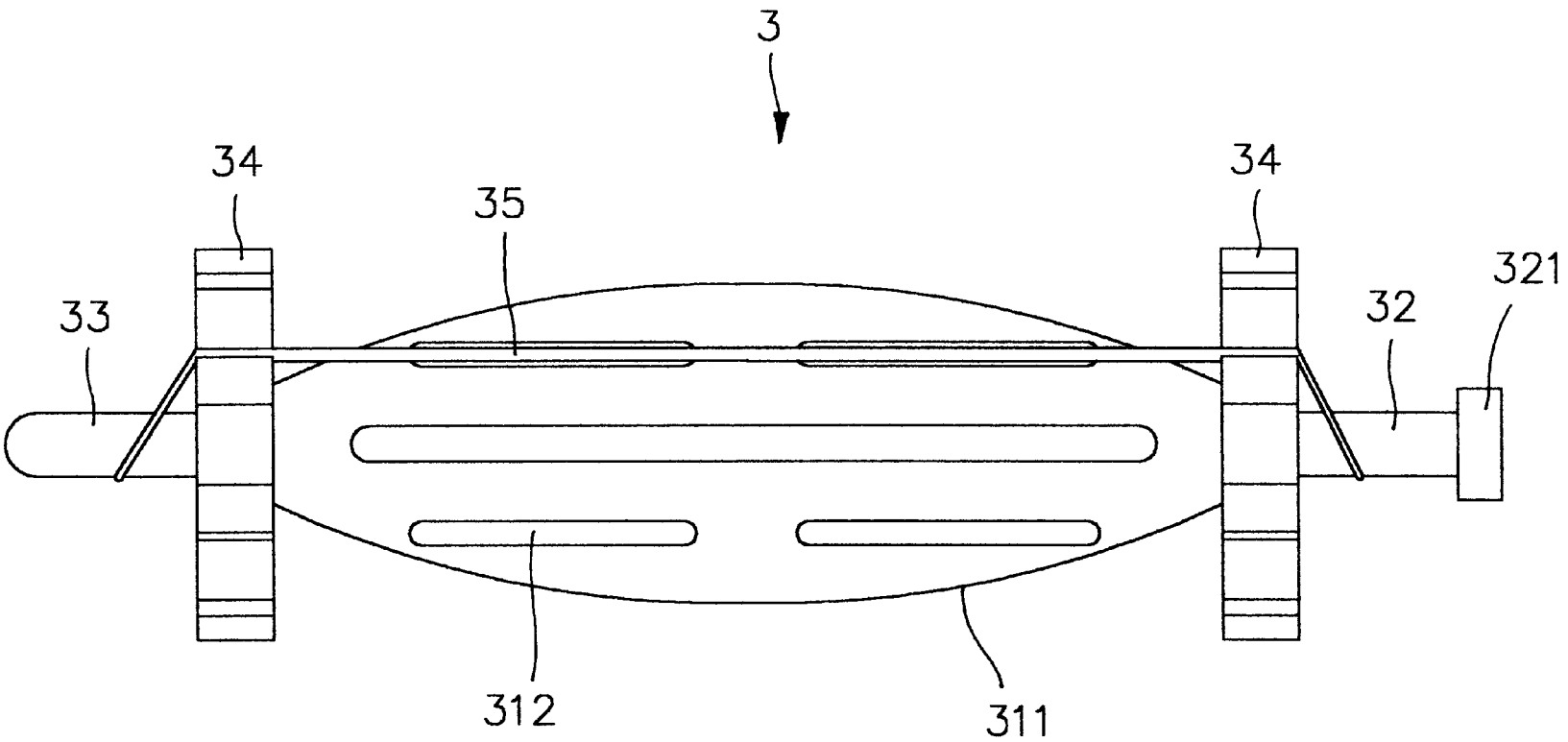
FIG. 8 is a side view of the second embodiment of a hair roller in the present invention.
Figure 9:
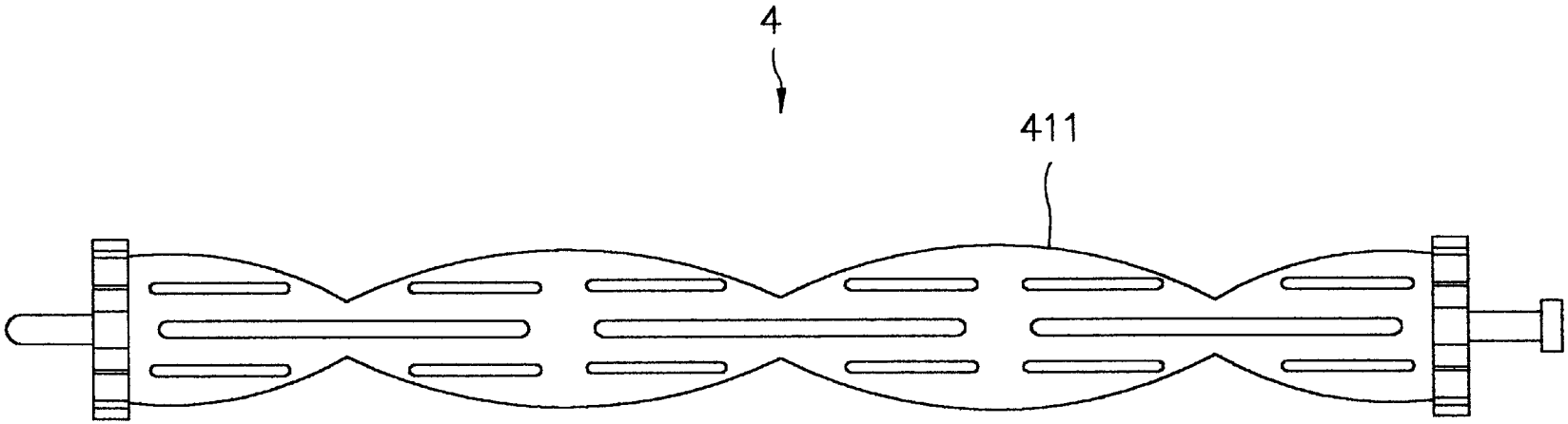
FIG. 9 is an elevational view of a third embodiment of a hair roller in the present invention.
Figure 10:
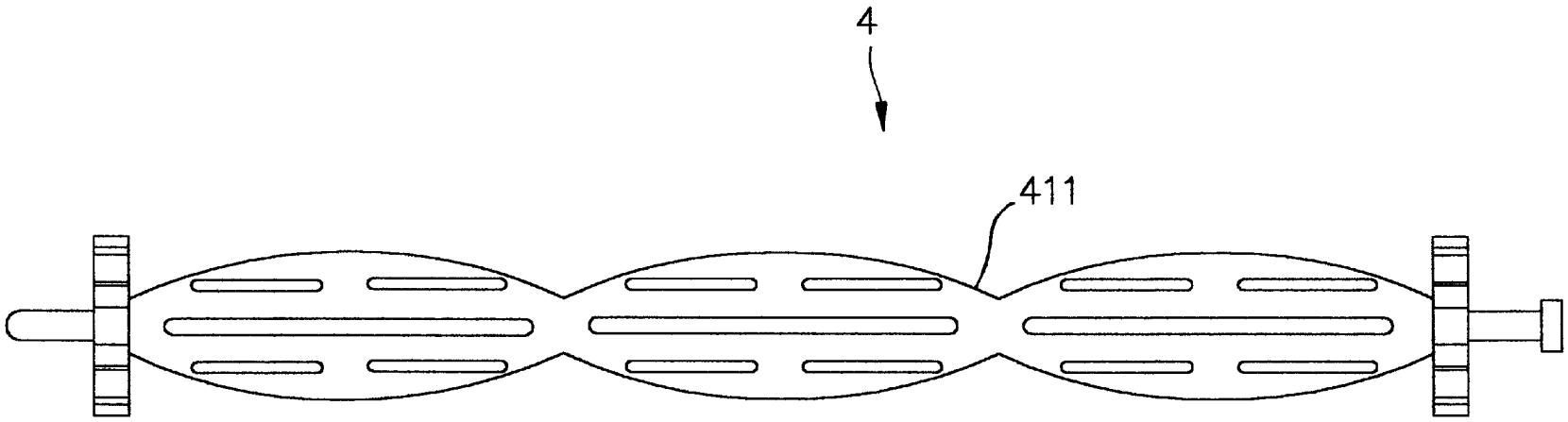
FIG. 10 is an elevational view of a fourth embodiment of a hair roller in the present invention.

Next, as shown in FIGS. 5, 6, the first embodiment of the hair roller 3 may have its diameter gradually increase from the center to the right and the left, becoming a hair roller 311, and as shown in FIGS. 7 and 8, the second embodiment of the hair roller 3 may have its diameter gradually decrease from the center to the right and the left, becoming a hair roller 311. Then changing of the diameter in those hair rollers 311 enables hairs set into various curlings or waves.

The third embodiment and the fourth embodiment of the hair roller 4 have a structure that two or more hair rollers 3 of the first and the second embodiment are connected together, increasing the outer curved surface 411 for reduce time and work necessary for hairdressing.

As can be understood from the aforesaid description, the invention has the following advantages.

1. Fast to handle. The hair roller can be wound around with the hair roller cloth only for operation.

2. Possibility of setting various curlings and waves. The hair roller has a regular change of its diameter, enabling setting hairs with only one kind of hair roller.

3. Protection of hairs. The ceramics powder of the hair roller cloth can produce far infrared light during hairdressing process to protect and nourish hairs from harming, and to keep the curls for a long period of time.

4. Easy replacement in case of breaking. The hair roller cloth can be easily replaced with new one in case of breaking, taken off the hair roller.

While the preferred embodiments of the invention have been described above, it will be recognized and understood that various modifications may be made therein and the appended claims are intended to cover all such modifications which may fall into the spirit and scope of the invention.

What is claimed is:

1. A hair roller cloth and a hair roller comprising:

a hair roller made of heat resistant material, having a circular cross-section so as to set various curlings and waves on hairs; and, a hair roller cloth directly wound around said hair roller, having ceramics powder coated on outer surfaces and a heating member for producing heat when electrified, said heating member heating up said ceramics powder, for hairdressing.

2. The hair roller cloth and the hair roller as claimed in claim 1, wherein said hair roller has a hanging ring respectively provided at two sides.

3. The hair roller cloth and the hair roller as claimed in claim 2, wherein said hair roller cloth is wound on an inner side of said hair roller.

4. the hair roller as claimed in claim 1, wherein said hair roller has the circular cross-section gradually increasing from a center to right and left extremities to form two curved-up stages of the outer surface.

5. The hair roller as claimed in claim 1, wherein said hair roller has the circular cross-sectional gradually decreasing from a center to right and left extremities to form two curved-down stages of the outer surface.

6. The hair roller as claimed in claim 1, wherein said hair roller has the same diameter along a length thereof.

7. The hair roller as claimed in claim 1, wherein said hair roller has a plurality of regular curved-up stages on the outer surface.

8. The hair roller as claimed in claim 1, wherein said hair roller has a plurality of regular curved-down stages on the outer surface.

9. A hair roller cloth comprising:

a heating member of a flat plate shape, having a side edge connected with a lead wire of a power source to be electrified;

an insulating layer covered completely on an outer surface of said heating member to insulate said heating member from leaking electricity to keep safety in using;

two metal net layers respectively placed on upper and lower surfaces of said insulating layer for transmitting heat of said heating member enabling bending and positioning after being bent; and, a cotton cloth layer placed on each of two outer surfaces of said metal net layers and coated with a layer of ceramics powder and surrounding said heating member, said insulating layer and said metal net layers.

* * * * *